US006648555B2

(12) United States Patent
Mommaas et al.

(10) Patent No.: US 6,648,555 B2
(45) Date of Patent: Nov. 18, 2003

(54) JACK-UP PLATFORM COMPRISING A DECK STRUCTURE AND A SINGLE SUPPORTING COLUMN, AND METHOD FOR INSTALLING SUCH JACK-UP PLATFORM

(75) Inventors: Cornelis J. Mommaas, Dordrecht (NL); Dirk Manschot, Lepelaarssingel (NL)

(73) Assignee: Marine Structure Consultants (MSC) B.V., Schiedam (NL)

( * ) Notice: Subject to any disclaimer, the term of this patent is extended or adjusted under 35 U.S.C. 154(b) by 0 days.

(21) Appl. No.: 09/936,996

(22) PCT Filed: Jan. 18, 2001

(86) PCT No.: PCT/NL01/00035

§ 371 (c)(1),
(2), (4) Date: Dec. 27, 2001

(87) PCT Pub. No.: WO01/55513

PCT Pub. Date: Aug. 2, 2001

(65) Prior Publication Data

US 2002/0159841 A1 Oct. 31, 2002

(51) Int. Cl.[7] ..... E02B 17/02; B63B 35/00
(52) U.S. Cl. ..... 405/224; 405/196; 405/203
(58) Field of Search ..... 405/195.1, 196, 405/200, 203, 222, 224, 224.1, 225

(56) References Cited

U.S. PATENT DOCUMENTS 4,265,568 A * 5/1981 Herrmann et al. ..... 405/196
4,378,178 A 3/1983 Roach ..... 405/224
4,704,051 A * 11/1987 Ellingvag ..... 405/224
4,969,776 A * 11/1990 Bunce et al. ..... 405/203
5,807,029 A * 9/1998 Ellnor ..... 405/204

FOREIGN PATENT DOCUMENTS

WO WO8100423 A 2/1981
WO WO85 04437 A 10/1985
WO WO 9533892 A 12/1995

* cited by examiner

*Primary Examiner*—Thomas B. Will
*Assistant Examiner*—Tara L. Mayo
(74) *Attorney, Agent, or Firm*—Pillsbury Winthrop LLP

(57) ABSTRACT

A jack-up platform comprising a deck structure, a column with a base structure and a jack-up system for moving the column and the deck structure relative to each other. The base structure comprises a base and at least three base supporting parts, while the deck structure, starting from at least three spaced coupling places, can be connected by a tensioning apparatus with at least three mutually spaced connecting places on or near the base supporting parts. Before the installation the platform, floating with pulled-up column, is brought to the desired location where the base supporting parts are brought into contact with the floor and the deck structure is raised out of contact with the water. After providing the tensioning apparatus and bringing the deck structure to working height, the tensioning apparatus is tensioned, for instance by slightly further raising the deck structure which is then secured relative to the column.

23 Claims, 2 Drawing Sheets

JACK-UP PLATFORM COMPRISING A DECK STRUCTURE AND A SINGLE SUPPORTING COLUMN, AND METHOD FOR INSTALLING SUCH JACK-UP PLATFORM

This application is the National Phase of International Application PCT/NL01/00035 filed Jan. 18, 2001 which designated the U.S. and which International Application was published under PCT Article 21(2) in English.

BACKGROUND OF INVENTION

1. Field of the Invention

The invention relates to a jack-up platform comprising a deck structure with floating power and a column with a base structure, in which a jack-up system acts on the column so as to be able to move and secure the deck structure and the column relative to each other, and the base structure comprises a base and at least three separate base supporting parts. The invention also relates to a method for installing such a jack-up platform.

2. Background of Related Art

Such a jack-up platform is known from WO-A-81/000423. Initially, such jack-up platforms were used in relatively shallow water, but in the course of time the use also shifted to increasingly deeper water, for which water depths of 300 meters and more may be considered. Even under these circumstances the jack-up platform must be stable and relatively rigid under all kinds of loads, for instance as a result of water flows and wind. On the other hand, for transport, handling and movement the structure must preferably be of light design. To meet these outwardly incompatible requirements, the structure, after installation on a sea floor, may be stiffened by means of guylines, as, for instance, known from U.S. Pat. No. 4,378,178. The provision of such guylines, however, is an extremely difficult and labor-intensive, if not, in particular in great depths, practically impossible activity.

SUMMARY OF THE INVENTION

The object of the invention is to provide a jack-up platform which meets the above incompatible requirements but which, at the same time, is relatively rapid and simple to install and move, even in great water depths.

According to the invention this object is achieved for a jack-up platform of the type described in the opening paragraph if the deck structure, through tensioning means starting from at least three spaced coupling places, can be connected with at least three mutually spaced connecting places on or near the base supporting parts. By taking these measures, a relatively light structure becomes possible, while the stability of the jack-up platform remains ensured through, on the one hand, the base structure with a base and a plurality of base supporting parts forming a multipoint support and, on the other hand, the stiffening of the whole jack-up platform in the operative position through the tensioning means between the coupling places and the connecting places, with at least one tensioning means extending between each coupling place and each connecting place. For this a kind of stay structure may be considered, with one or a plurality of tensioning means extending between each connecting place and each coupling place and/or tensioning means extending from a coupling or connecting place to more than one connecting or coupling place. A sufficiently rigid whole, however, can already be realized if each connecting place is connected with a coupling place through one tensioning means, while these tensioning means preferably extend vertically, which results in a structure to be realized in a relatively simple manner.

Since a body with a three-point support can essentially be installed so as to be completely stable, it is preferred according to a further embodiment of the invention that three base supporting parts are provided, which are substantially symmetrically arranged around the column, which extends through an opening centrally provided in the deck structure.

The tensioning means can be realized in many ways, for which a tensioning means may be considered which has the form of an elongated element consisting of at least one pipe, rod, chain, cable or similar element. It is also possible that a tensioning means has the form of a composite lattice body, which, for that matter, can be of substantially lighter design than the conventional lattice supporting columns in the conventional known jack-up platforms, because such a tensioning means column has no supporting function and is under tensile stress, instead of compression stress.

To increase the floating power of the jack-up platform when towing it to the desired location, it may be provided that at least the base or at least one of the base supporting parts comprises a body with floating power, such as a tank. In the operative position of the jack-up platform such a body can further be advantageously used for all kinds of storage and transshipment purposes.

Also, according to a further embodiment of the invention, it may be preferred that the base structure can be pulled up into a suitable hole provided in the deck structure, which can reduce the traveling resistance during the conveyance of the jack-up platform to the installation site. In this case it will further often be preferred that the base structure is vertically of relatively flat design so that the height of the deck structure, in its totality, can also remain relatively low.

If according to a further embodiment of the invention the deck structure is composed of a lower part and an upper part, the upper part receding relative to the lower part over at least part of the circumference, the jack-up platform can be partly sunk in the manner of a semi-submersible, that is to say sunk so far that the broader lower part is under the water surface and the narrower upper part at least partly above. Thus the jack-up platform can be made more independent of wave motion when lowering the column and bringing the base structure into contact with the floor. This effect can further be optimized if the deck structure consists of an edge body surrounding a central through hole, in which hole the jack-up system is centrally and locally installed. It is further preferred that the receding part of the upper part adjoins the central through hole. Over the entire height of the deck structure the exterior of the jack-up platform may have a form adjusted to a minimum traveling resistance.

To obtain a proper anchoring of the column to the floor, it may be preferred, depending on the nature of the floor, that near the base supporting parts an apron-shaped extension is provided, which can penetrate into the sea floor.

Under the circumstances it will not always be possible that the base supporting parts are supported on a flat horizontal surface. In this connection it is preferred according to a further embodiment of the invention that means are provided to apply a filling material, such as grout, under a base supporting part so that by supplying such a filling material near at least one of the base supporting parts the column can always be pressed into a purely vertical position and be aligned. As counterpart thereof or in addition thereto it is also possible to provide means for creating a reduced pressure under a base supporting part.

The invention also relates to a method for installing a jack-up platform as discussed above. To this end, it is proposed according to the invention that the platform, floating in the water with a pulled-up column, is brought to the desired location where the column with its base supporting parts is brought into supporting contact with the floor under water, the deck structure is raised along the column so as to be out of contact with the water, the support of the base supporting parts on the floor is completed while vertically aligning the column, each connecting place on or near the base supporting parts is connected through a tensioning means with at least one coupling place on the deck structure, the tensioning means are tensioned after bringing the deck structure to working height, and the deck structure is secured relative to the column.

To be able to carry out the provision of the tensioning means in a relatively simple manner, that is to say without many underwater operations, in particular in greater depths, it may be preferred according to a further embodiment of the invention that the tensioning means are fixed from the deck structure in the connecting places before the column is brought downward and, via the base structure, into supporting contact with the floor. If desired, the tensioning means may also be continuously fixed in the connecting places.

If the platform is provided with a deck structure with a lower part and an upper part receding at least partly relative to the lower part, it may be realized according to a further embodiment of the invention that before lowering the column the deck structure is sunk until the broader lower part is under the water surface. It is thus possible by sinking the jack-up platform partly in the manner of a submersible to lower the column and to install the base structure on the floor while being less dependent on wave motion.

Depending on the circumstances, it may further be preferred from a viewpoint of stability that the installation method is supplemented with an additional intermediate step in the sense that, after installing the base structure on the floor, completion of the support between the base supporting parts and the floor and vertical alignment of the column take place when the deck structure is raised to a relatively low height above the water surface, after which the deck structure is raised to the desired working height before the tensioning means are subjected to tension.

The tensioning of the tensioning means can take place in many well-known ways. According to a further embodiment of the invention, however, it is preferred that the available jack-up system is advantageously used, which is simply possible if the tensioning means are subjected to tension by further raising the deck structure over a predetermined distance.

To keep the required navigable depth for the jack-up platform as low as possible during transport to the site where it needs to be installed, it may further be preferred that, when bringing the platform to the desired location, the column is pulled up so far that the base structure is in the immediate vicinity of the floating deck structure, which position can be realized with the jack-up system in a simple manner. To even further reduce the water resistance experienced during traveling, it is preferred that the column is pulled up so far that the base structure is completely within a space provided in the deck structure for this purpose.

BRIEF DESCRIPTION OF THE DRAWINGS

With reference to exemplary embodiments schematically shown in the drawings the jack-up platform and the installation method as proposed by the invention will now be explained in more detail, although only by way of example. In these drawings.

DETAILED DESCRIPTION OF EMBODIMENTS OF THE INVENTION

Figure 1:
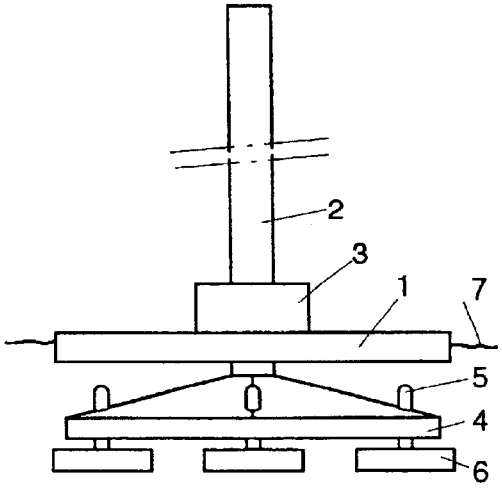
FIG. 1 is a side view of a first embodiment of a jack-up platform according to the invention, floating in a water.
Figure 2:
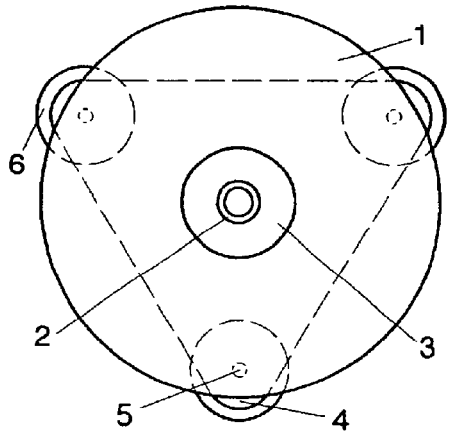
FIG. 2 is a top view of the jack-up platform of FIG. 1.

The jack-up platform shown in FIGS. 1 and 2 comprises a substantially disk-shaped deck structure 1 with floating power, which deck structure is provided with a through opening for longitudinally and slidably taking up a column 2, which is slidable and securable with respect to the deck structure 1 by means of a jack-up system 3. Attached to the lower end of the column 2 is a base 4 having a substantially pyramidal configuration with three angular points, which base 4, near each angular point, carries a base supporting part 6 via a rod part 5 extending through the base 4.

FIG. 1 shows the jack-up platform in a position floating in a water with a surface 7. In this position the column 2 is raised by means of the jack-up system 3 so far that the base 4 is situated at a short distance below the deck structure 1. Thus the jack-up platform can be towed at its shallowest draft to the position where it needs to be installed. Moreover, in this position the traveling resistance is lowest.

Figure 3:
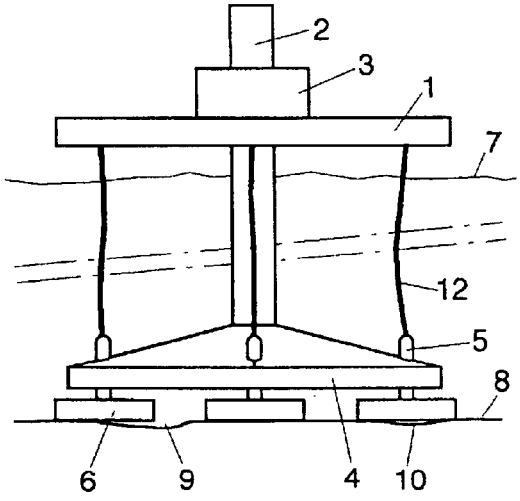
FIG. 3 is an intermediate phase when placing the jack-up platform on a floor under water.

Arrived at the destination, the installation of the jack-up platform is started by lowering the column 2 with the base 4 relative to the deck structure 1 via the jack-up system 3 until the base supporting parts 6 begin to rest on the floor 8 under water. The jack-up system 3 then still remains active so that the deck structure 1 is raised along the column 2 to above the water surface 7, as shown in FIG. 3.

The floor 8 may be flat, but may also show irregularities in the form of pits 9 and 10 so that a base supporting part 6 does not to its full size make contact with the floor 8 or even sinks farther than the other base supporting parts 6 so that the column 2 begins to assume a position which is no longer purely vertical.

Figure 4:
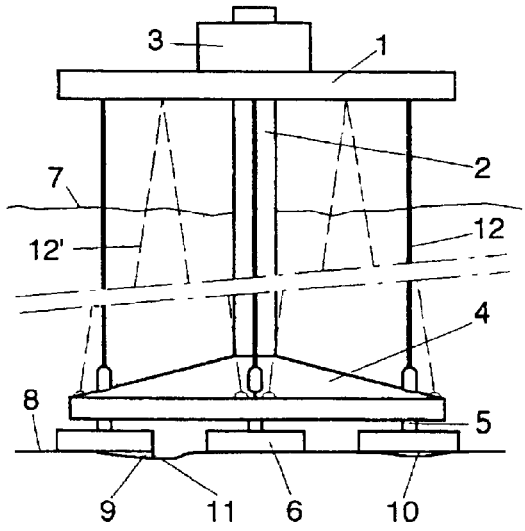
FIG. 4 is a view of the jack-up platform in the installed position.

To be able to allow for such floor irregularities, various measures are possible. Thus, for instance, to achieve a firm anchoring to the floor 8, a downwardly extending apron-shaped extension penetrating into the floor 8 may be provided at the bottom of a base supporting part 6, as schematically shown in FIG. 4 by reference numeral 11. Also, such an apron-shaped extension may be used to form an enclosed space, into which a filling material, such as grout, may be pressed. This may be done, for instance, via outlets not shown in the drawing, in the lower surface of the base supporting parts 6, which outlets may communicate with conduits extending, for instance, through the base 4 and the column 2 into and/or above the deck structure 1. Thus the pit 10 located completely under a base supporting part 6 can be filled as well. A further possibility is to create a reduced pressure under the base supporting parts 6. Thus, for the base supporting parts 6 a stable installation can be realized, that is to say such that the column 2 can be brought to and held in a substantially vertical position, after which the deck structure 1 is brought to and secured at working height by means of the jack-up system 3.

To increase the stability of the jack-up platform in its totality, tensioning means 12 are provided, which extend vertically between an upper end of a rod part 5 and the deck structure 1 and are subjected to tension with the deck structure 1 at working height so that the jack-up platform structure is stiffened. The tensioning of the tensioning means 12 can be carried out by using means provided in or on the deck structure 1. It is, however, simpler for this to make use of the jack-up system 3, that is to say to further raise the deck structure 1 over the distance required for the desired tension and secure the deck structure in that position.

In the Figures the tensioning means 12 are shown as cables or wires. The provision thereof is possible in a relatively simple manner by connecting the tensioning means 12 permanently with the upper ends of the rod parts 5 or establishing that connection when the platform is in the position shown in FIG. 1. When lowering the column 2 with base 4, the tensioning means 12 are pulled along in untensioned condition, as shown in FIG. 3. Once the desired working height has been reached, the tensioning means 12 are fixed and then tensioned by activating the jack-up system 3.

Instead of by cables, the tensioning means 12 may also be formed by section or rod structures, which can be of rather slender design because they are under tensile stress only. Furthermore, it is possible to compose each tensioning means, if desired, of more than one cable or of a combination of cables, rods, pipes, chains and/or similar elements. Instead of being vertical, the tensioning means may also be inclined, like the tensioning means 12' indicated in FIG. 4 by a broken line, which are further not attached to the rod parts 5 belonging to the base supporting parts 6 but to the base 4 near the base supporting parts 6. Of course, both vertical and inclined tensioning means may be present, and inclined tensioning means may cross each other.

The column 2 is shown in the Figures as a tube structure having an annular cross-section. This may also be any other desired and suitable cross-section. It has already been mentioned that through the column grout conduits may extend upwardly. In the column further provisions may be housed, such as conduits for production and exportation of oil and/or gas, for instance when the jack-up platform serves as transshipment station for oil and/or gas recovered in other places. These products are supplied through pipes extending over the floor and then brought up via pipes extending through the column onto or into the deck structure 1 from where these products can be transferred into tankers.

To increase the floating power, the base supporting parts 6 may be designed as hollow bodies, which, after installation of the jack-up platform, may serve as storage and transshipment tanks. Similar provisions may be housed in the base 4, which, for that matter, may also be designed as lattice structure, which is also true of the base supporting parts.

The above-mentioned but not specified jack-up system which ensures a relative vertical movement between column and deck structure may be of the known type in which vertically movable supports are provided with pins capable of being slid in and out, cooperating with openings longitudinally provided in the column in rows, or of the known rack-and-pinion type, or any other suitable type of jack-up system.

Figure 5:
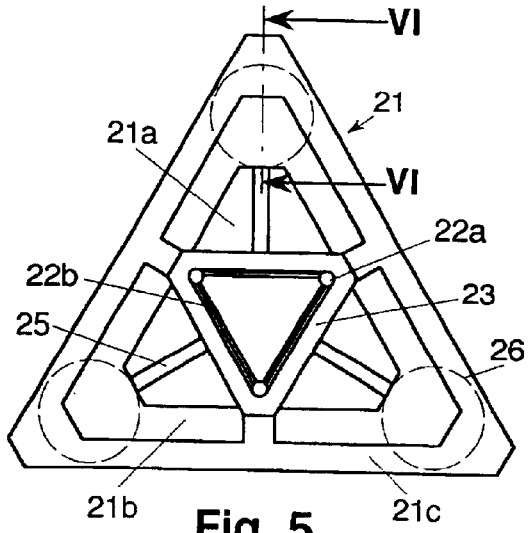
FIG. 5 is a top view of a second embodiment of a platform according to the invention.
Figure 6:
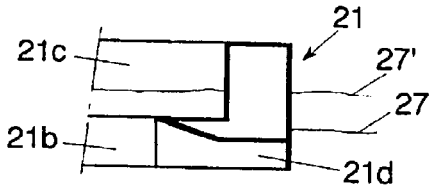
FIG. 6 is a cross-section taken along the line VI—VI in FIG. 5.
Figure 7:
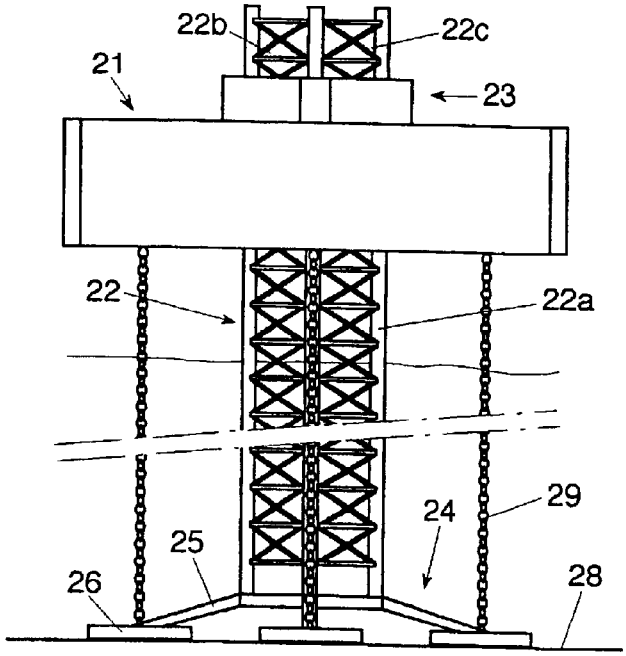
FIG. 7 is a front view of the jack-up platform of FIG. 5.

The jack-up platform shown in FIGS. 5–7 comprises a deck structure 21, a column 22 and a jack-up system 23. The column 22 is provided at its lower end with a base structure 24 provided with three supporting legs 25 forming part of a base, each carrying a base supporting part 26.

The deck structure 21 has a substantially triangular form with a likewise substantially triangular central through hole 21*a,* above and in which is placed the jack-up system 23 for the column 22. The central through hole 21*a* is surrounded by a shell part composed of a lower part 21*b* and an upper part 21*c*. As appears from FIG. 6, the upper part 21*c*, viewed from the central through hole 21*a*, recedes by steps relative to the lower part 21*b*, and the outer circumferential walls of the parts 21*b* and 21*c* coincide. In the lower part 21*b* is locally provided at each angular point a screened but downwardly open space 21*d* which can completely take up a base supporting part 26 and a part of a supporting leg 25. Consequently, the base structure 24 can be retracted completely within the outer circumference of the deck structure 21, which, as compared to the embodiment of FIG. 1, reduces the traveling resistance of the jack-up platform during a floating movement.

In this exemplary embodiment the column 22 is shown as a lattice column composed of uprights 22*a* which are mutually connected by cross bars 22*b* and stays 22*c*.

The procedure when installing the jack-up platform of FIGS. 5–7 is substantially equal to the procedure described above with reference to FIGS. 1–4, although before lowering the column 22 the deck structure 21 is partly sunk first. The structure of the jack-up platform is such that during the movement thereof in floating condition the upper side of the lower part 21*b* is above the water surface. This surface is indicated in FIG. 6 by the line 27. Arrived at the destination, the jack-up platform is sunk so far that the lower part 21*b* is completely under water. The water surface belonging thereto is indicated in FIG. 6 by the line 27'. It is thus realized that the natural periods in floating condition can be adjusted such that when lowering the column 22 and bringing the base supporting parts 26 into contact with the floor 28 the movements are optimal, that is to say wave motion will affect the position of the jack-up platform as less as possible so that the column 22 can be installed as gently as possible, that is with a minimum of shocks.

After the foundation and alignment operations, and after bringing the deck structure 21 to working height, the tensioning means 29, here shown as chains, are subjected to the desired tension by raising the deck structure 21 a little further, to stabilize and stiffen the installed working platform.

It is self-explanatory that within the framework of the invention as laid down in the appended claims many further modifications and variants are possible outside those shown in the Figures and discussed above. Thus, for instance, it is possible to design the upper part 21*c* of the deck structure 21, if desired, as a deck body having a large upper surface which is only locally connected with the lower part 21*b* so as to further reduce the effect of wave motion on the deck structure 21 when lowering the column 22.

What is claimed is:

1. A jack-up platform comprising a deck structure with buoyancy and a column with a base structure, in which a jack-up system acts on the column so as to be able to move and secure the deck structure and the column relative to each other, and the base structure comprises a base and at least three separate base supporting parts, wherein the deck structure, through at least one tensioning means starting from at least three spaced coupling places positioned on the deck structure and distanced from the column, can be connected with at least three mutually spaced connecting places on the base structure and on or near the at least three separate base supporting parts.

2. A jack-up platform according to claim 1, wherein at least one tensioning means extends between each coupling place and each connecting place.

3. A jack-up platform according to claim 1 wherein three base supporting parts are provided which are substantially symmetrically arranged around the column which extends through an opening centrally provided in the deck structure.

4. A jack-up platform according to claim 1, wherein at least a plurality of the tensioning means extends as stay elements deviating from the vertical between the at least three coupling places and the at least three connecting places.

5. A jack-up platform according to claim 1, wherein at least one of said at least three connecting place is connected with at least one of said at least three coupling place through one of said at least one tensioning means.

6. A jack-up platform according to claim 5, wherein the tensioning means extend vertically.

7. A jack-up platform according to claim 1, wherein a tensioning means has the form of an elongated element consisting of at least one pipe, rod, chain, or cable.

8. A jack-up platform according to claim 1, wherein at least the base or at least one of the base supporting parts comprises a body with buoyancy.

9. A jack-up platform according to claim 1, wherein the base structure can be pulled up into a hole configured to accept the base structure, provided in the deck structure.

10. A jack-up platform according to claim 1, wherein the base structure is of relatively flat design in a vertical direction.

11. A jack-up platform according to claim 1, wherein the deck structure is composed of a lower part and an upper part, which upper part recedes relative to the lower part over at least part of the circumference of the lower part.

12. Twice A jack-up platform according to claim 1, wherein the deck structure consists of an edge body surrounding a central through-hole, in which hole the jack-up system is centrally and locally installed.

13. A jack-up platform according to claim 1, wherein the deck structure is composed of a lower part and an upper part, which upper part recedes a relative to the lower part over at least part of the circumference; wherein the deck structure consists of an edge body surrounding a central through-hole, in which the jack-up system is centrally and locally installed; and wherein the receding part of the upper part adjoins the central through hole.

14. A jack-up platform according to claim 1, wherein at least one of the base supporting parts is provided with an apron shaped extension which can penetrate into a sea floor.

15. A jack-up platform according to claim 1, wherein a filling material is provided under at least one of said at least three base supporting parts.

16. A jack-up platform according to claim 1, wherein means are provided to create a reduced pressure under at least one of said at least three base supporting parts.

17. A method for installing a jack-up platform comprising a deck structure with buoyancy and a column with a base structure, in which a jack-up system acts on the column so as to be able to move and secure the deck structure and the column relative to each other, and the base structure comprises a base and at least three separate base supporting parts, wherein the deck structure, through at least one tensioning means starting from at least three spaced coupling places positioned on the deck structure and distanced from the column, can be connected with at least three mutually spaced connecting places on the base structure and on or near the at least three separate base supporting parts, the method comprising comprising:

bringing the platform, floating in the water with a pulled-up column to a desired location where the column with its base supporting parts is brought into supporting contact with the floor under water;

raising the deck structure along the column so as to be out of contact with the water, and the support of the base supporting parts on the floor is completed;

vertically aligning the column, wherein each connecting place on or near the base supporting parts is connected by a tensioning means with at least one coupling place on the deck structure, the tensioning means are tensioned after raising the deck structure to working height, and the deck structure is secured relative to the column.

18. A method according to claim 17, further comprising fixing the tensioning means from the deck structure to the at least three connecting places before the column is brought downward and, via the base structure, into supporting contact with the floor.

19. A method according to claim 17, further comprising sinking the deck structure, said deck structure comprising a lower part and an upper part said upper part being at least partly receded relative to the lower part of the deck structure, before lowering the column, until the broader lower part is under the water surface.

20. A method according to claim 17, wherein the completion of the support between the base supporting parts and the sea floor, and the vertical alignment of the column take place when the deck structure is raised to a relatively low height above the water surface, after which the deck structure is raised to the desired working height before the tensioning means are subjected to tension.

21. A method according to claim 17, wherein the tensioning means are subjected to tension by further raising the deck structure over a predetermined distance.

22. A method according to claim 17, further comprising pulling the column up so that the base structure is in the immediate vicinity of the floating deck structure when bringing the platform to the desired location.

23. A method according to claim 17, further comprising pulling up on the column so that the base structure is completely within a space provided in the deck structure.

* * * * *

UNITED STATES PATENT AND TRADEMARK OFFICE

CERTIFICATE OF CORRECTION

PATENT NO. : 6,648,555 B2 
DATED : November 18, 2003
INVENTOR(S) : Cornelis J. Mommaas and Dirk Manschot It is certified that error appears in the above-identified patent and that said Letters Patent is hereby corrected as shown below:

Title page,
Insert item:
-- [30] Foreign Application Priority Data
January 19, 2000 (NL) ..... 1014122 --

Signed and Sealed this

Twenty-seventh Day of April, 2004

JON W. DUDAS
*Acting Director of the United States Patent and Trademark Office*